US011616308B2

(12) United States Patent
Jan et al.

(10) Patent No.: US 11,616,308 B2
(45) Date of Patent: Mar. 28, 2023

(54) REFLECTOR STRUCTURE AND ANTENNA DEVICE

(71) Applicant: Wistron NeWeb Corporation, Hsinchu (TW)

(72) Inventors: Cheng-Geng Jan, Hsinchu (TW); Yu-Hsin Ye, Hsinchu (TW); Kuang-Yuan Ku, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 41 days.

(21) Appl. No.: 17/351,482

(22) Filed: Jun. 18, 2021

(65) Prior Publication Data

US 2022/0037794 A1 Feb. 3, 2022

(30) Foreign Application Priority Data

Jul. 30, 2020 (TW) ..... 109125869

(51) Int. Cl.

| | |
|---|---|
| ***H01Q 15/14*** | (2006.01) |
| ***H01Q 13/10*** | (2006.01) |
| ***H01Q 21/26*** | (2006.01) |
| ***H01Q 19/10*** | (2006.01) |

(52) U.S. Cl.

CPC ..... *H01Q 15/14* (2013.01); *H01Q 13/106* (2013.01); *H01Q 19/108* (2013.01); *H01Q 21/26* (2013.01)

(58) Field of Classification Search

CPC .... H01Q 15/14; H01Q 13/106; H01Q 19/108; H01Q 21/26

See application file for complete search history.

(56) References Cited

U.S. PATENT DOCUMENTS

| | | | | |
|---|---|---|---|---|
| 6,342,864 | B1 | 1/2002 | Muramoto et al. | |
| 7,148,848 | B2 * | 12/2006 | Colburn | H01Q 5/357 343/810 |
| 9,496,615 | B2 * | 11/2016 | Hsu | H01Q 15/008 |
| 9,786,998 | B2 * | 10/2017 | Liu | H01Q 21/29 |
| 10,587,051 | B2 * | 3/2020 | Hsu | H01Q 5/385 |
| 11,101,536 | B2 * | 8/2021 | Hsiao | H01P 5/1022 |

* cited by examiner

*Primary Examiner* — Vibol Tan
(74) *Attorney, Agent, or Firm* — McClure, Qualey & Rodack, LLP

(57) ABSTRACT

A reflector structure is configured to connect an antenna. The antenna has an excitation source. The reflector structure includes a metal substrate, at least one first flat plate and a second flat plate. The metal substrate is configured to reflect the radiation of the antenna. The at least one first flat plate is disposed on the metal substrate. The second flat plate is floated to the metal substrate along a virtual normal and completely separated from the at least one first flat plate to form a closed slot. A cavity is formed by the metal substrate, the at least one first flat plate and the second flat plate and communicated with the closed slot. The excitation source is projected onto a plane to form an excitation source region. The excitation source region is located in the second flat plate.

18 Claims, 14 Drawing Sheets

100

200

300

REFLECTOR STRUCTURE AND ANTENNA DEVICE

RELATED APPLICATIONS

This application claims priority to Taiwan Application Serial Number 109125869, filed Jul. 30, 2020, which is herein incorporated by reference.

BACKGROUND

Technical Field

The present disclosure relates to a reflector structure and an antenna device. More particularly, the present disclosure relates to a reflector structure having a closed slot and a cavity and an antenna device thereto.

Description of Related Art

In recent years, a wireless network becomes more developed and widespread. The wireless network is everywhere no matter in a public space, educational place, or a house. With the advent of the 5th Generation Mobile Networks (5G), the demand for high gain antennas is increased. In order to increase the antenna gain, the conventional art uses an additional structure to increase the reflection efficiency of the antenna, but it also increases the overall volume of the antenna and causes inconvenience in assembly.

Due to the limitation of the physical size of the antenna, the antenna often needs a certain amount of space to achieve high gain characteristics. With existing products heading towards miniaturization, end customers hope to further reduce the size of the antenna.

In view of this, how to reduce the height and the overall volume of the antenna, and maintain excellent antenna performance for the problems of the above-mentioned antenna becomes the goal of the public and relevant industry efforts.

SUMMARY

According to an embodiment of the present disclosure, a reflector structure is configured to reflect a radiation of an antenna having an excitation source. The reflector structure includes a metal substrate, at least one first flat plate and a second flat plate. The metal substrate is configured to reflect the radiation of the antenna, and a center of the metal substrate has a virtual normal. The at least one first flat plate is disposed on the metal substrate. The second flat plate is floated to the metal substrate along the virtual normal, and completely separated from the at least one first flat plate to form a closed slot. A cavity is formed by the metal substrate, the at least one first flat plate and the second flat plate, and communicated with the closed slot. The closed slot is located on a plane, the excitation source is projected onto the plane to form an excitation source region, and the excitation source region is located in the second flat plate.

According to another embodiment of the present disclosure, an antenna device includes an antenna structure and a reflector structure. The antenna structure has at least one excitation source. The reflector structure is configured to reflect a radiation of the antenna structure. The reflector structure includes a metal substrate, at least one first flat plate and a second flat plate. The metal substrate has a virtual normal. The at least one first flat plate is disposed on the metal substrate. The second flat plate is floated to the metal substrate along the virtual normal, and completely separated from the at least one first flat plate to form a closed slot. A cavity is formed by the metal substrate, the at least one first flat plate and the second flat plate, and communicated with the closed slot. The closed slot is located on a plane, the at least one excitation source is projected onto the plane to form an excitation source region, and the excitation source region is located in the second flat plate.

BRIEF DESCRIPTION OF THE DRAWINGS

The present disclosure can be more fully understood by reading the following detailed description of the embodiment, with reference made to the accompanying drawings as follows.

DETAILED DESCRIPTION

The embodiment will be described with the drawings. For clarity, some practical details will be described below. However, it should be noted that the present disclosure should not be limited by the practical details, that is, in some embodiment, the practical details is unnecessary. In addition, for simplifying the drawings, some conventional structures and elements will be simply illustrated, and repeated elements may be represented by the same labels.

It will be understood that when an element (or device) is referred to as be "connected to" another element, it can be directly connected to the other element, or it can be indirectly connected to the other element, that is, intervening elements may be present. In contrast, when an element is referred to as be "directly connected to" another element, there are no intervening elements present. In addition, the terms first, second, third, etc. are used herein to describe various elements or components, these elements or components should not be limited by these terms. Consequently, a first element or component discussed below could be termed a second element or component. Besides, a combination of these elements (unite or circuits) of the present closure is not a common combination in this art, so it cannot be predicted whether a relation of the combination hereof can be easily done by a person having skill in the art by these elements (units or circuits).

Figure 1:
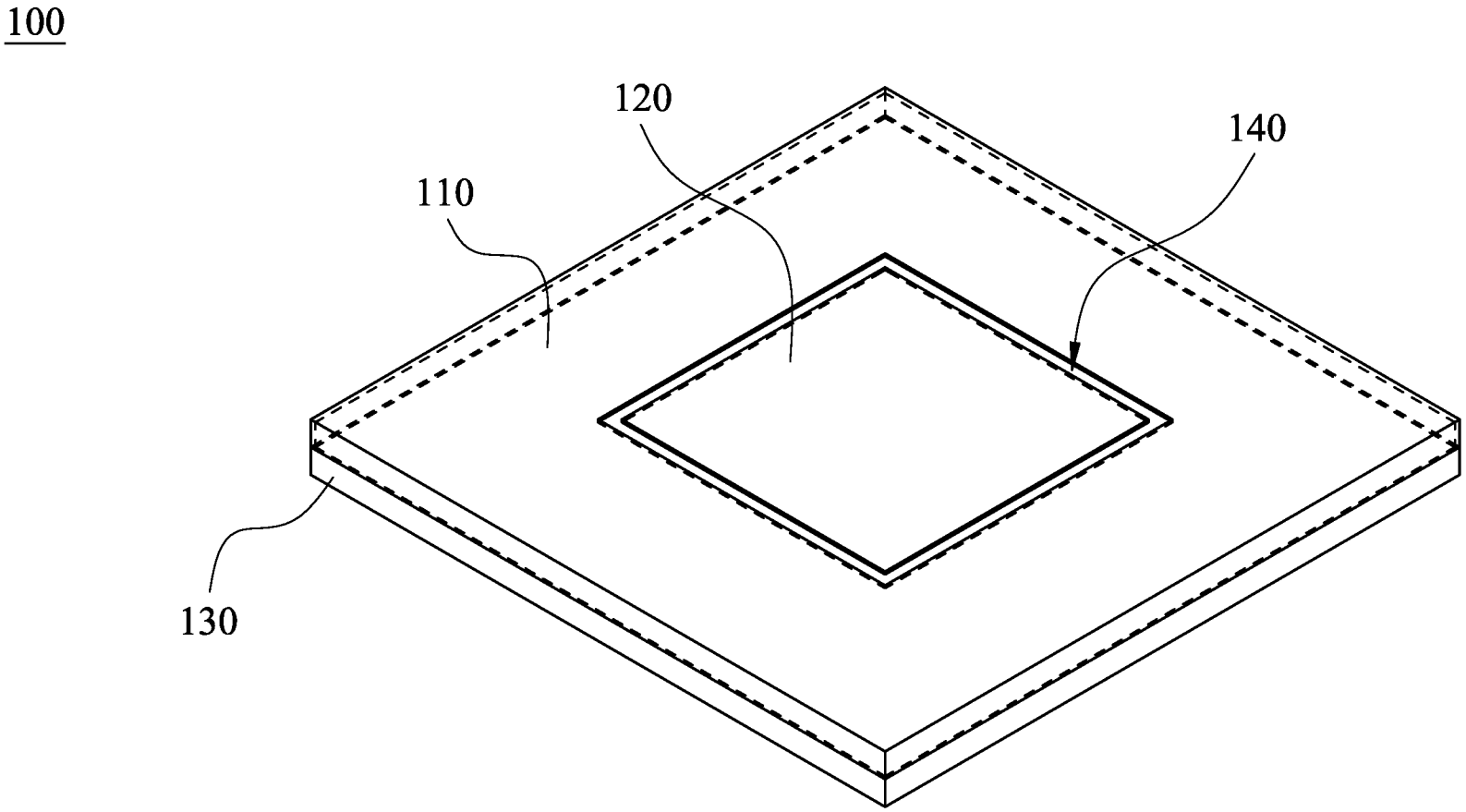
FIG. 1 is a three-dimensional schematic view of a reflector structure according to the 1st embodiment of a structural aspect of the present disclosure.
Figure 2:
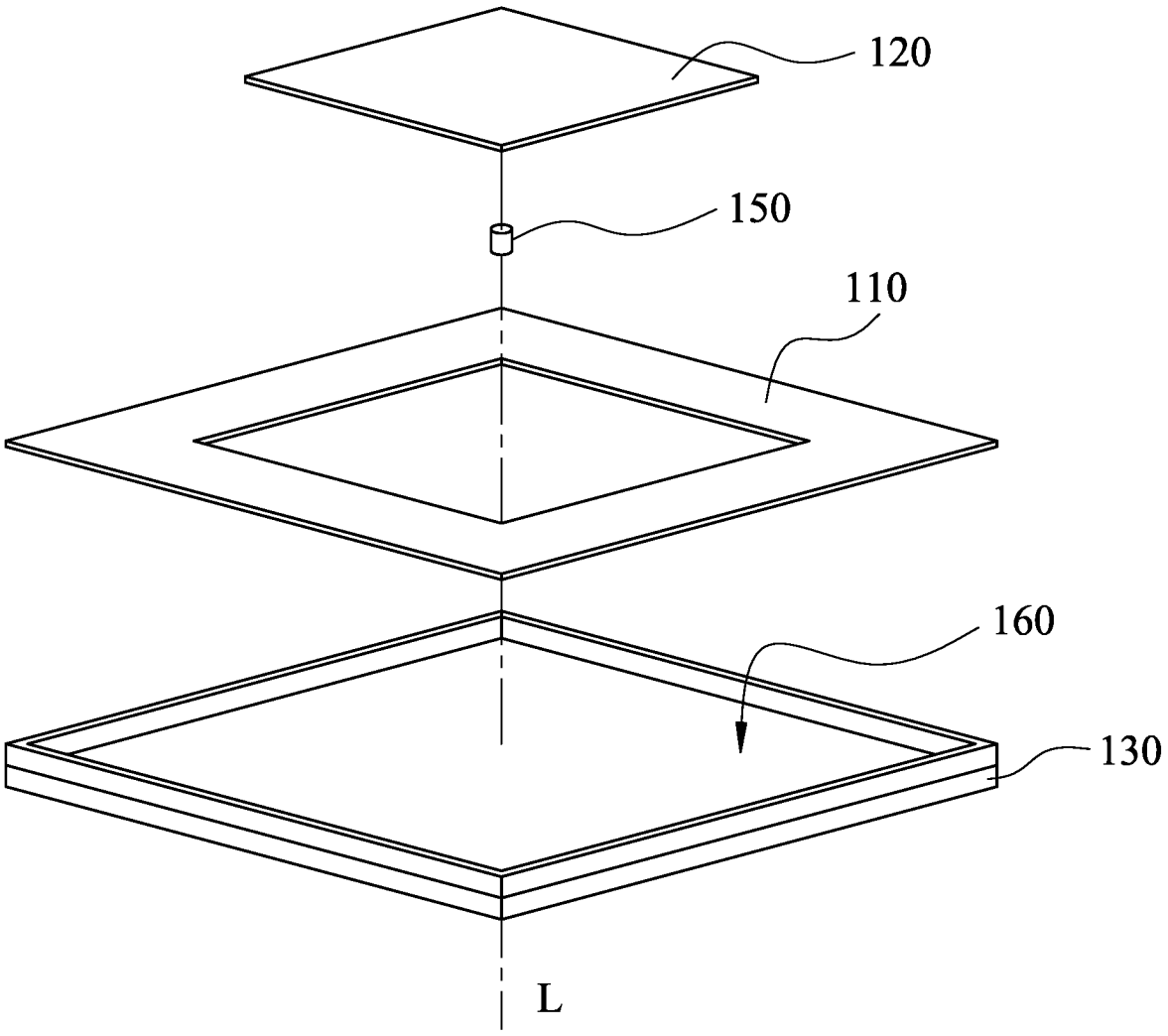
FIG. 2 is an exploded view of the reflector structure of FIG. 1.

Please refer to FIGS. 1 and 2. FIG. 1 is a three-dimensional schematic view of a reflector structure 100 according to the 1st embodiment of a structural aspect of the present disclosure; and FIG. 2 is an exploded view of the reflector structure 100 of FIG. 1. The reflector structure 100 is connected to an antenna structure, and configured to reflect a radiation of the antenna structure having an excitation source.

In FIGS. 1 and 2, the reflector structure 100 includes at least one first flat plate 110, a second flat plate 120 and a metal substrate 130. The metal substrate 130 is mainly configured to reflect the radiation of the antenna, and a center of the metal substrate 130 has a virtual normal L. The at least one first flat plate 110 is disposed on the metal substrate 130. The second flat plate 120 is floated to the metal substrate 130 along the virtual normal L, and completely separated from the at least one first flat plate 110 to form a closed slot 140. In specific, the reflector structure 100 can further include a support element 150 which is disposed between the second flat plate 120 and the metal substrate 130 to support and prop against the second flat plate 120.

Specifically, a cavity 160 is formed by the metal substrate 130, the at least one first flat plate 110 and the second flat plate 120, and communicated with the closed slot 140. The closed slot 140 is located on a plane (its reference numeral is omitted). The excitation source is projected onto the plane to form an excitation source region (that is, the position of the excitation source in the plane of the closed slot 140), and the excitation source region is located in the second flat plate 120. Further, the at least one first flat plate 110, the second flat plate 120 and the closed slot 140 can be located on the plane. Therefore, the reflector structure 100 of the present disclosure can be applied to a metal reflector of the antenna, and can change the radiation path of the antenna through the closed slot 140 and the cavity 160 so as to increase an antenna gain. Further, it is worth noting that the closed slot 140 of FIG. 1 is rectangular, and can also be circular or polygonal, but the present disclosure is not limited thereto.

Figure 3:
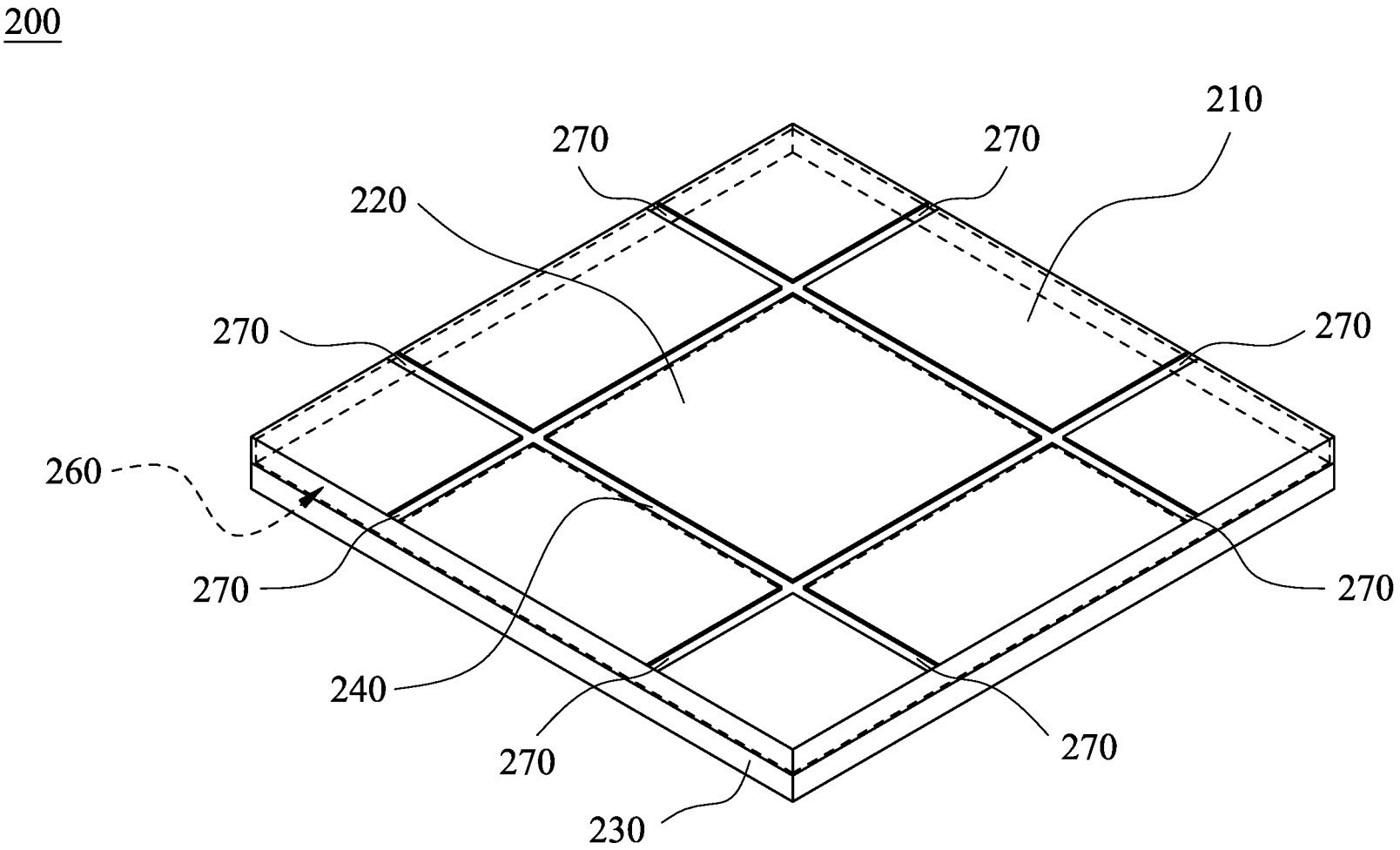
FIG. 3 is a three-dimensional schematic view of a reflector structure according to the 2nd embodiment of the structural aspect of the present disclosure.
Figure 4:
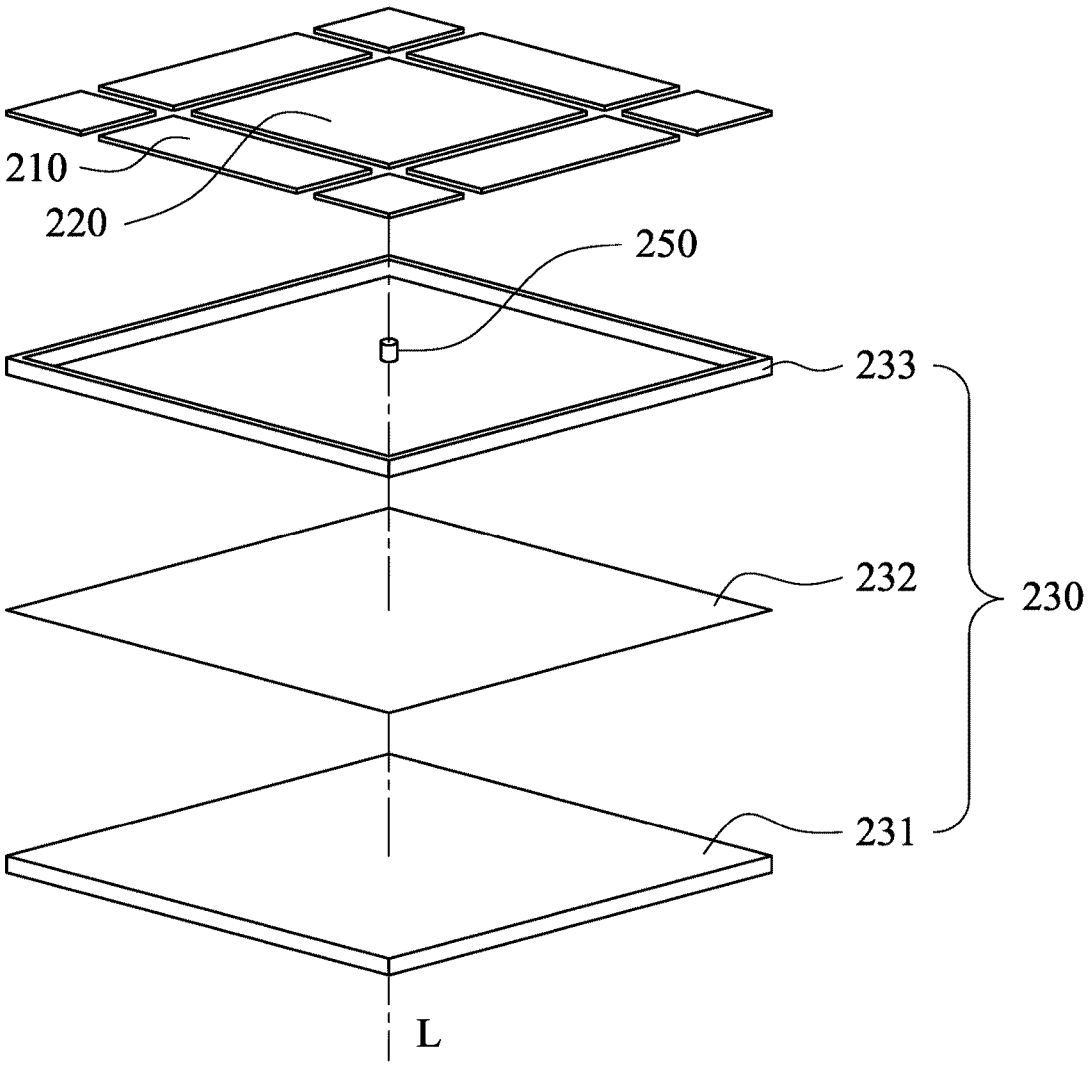
FIG. 4 is an exploded view of the reflector structure of FIG. 3.

Please refer to FIGS. 3 and 4. FIG. 3 is a three-dimensional schematic view of a reflector structure 200 according to the 2nd embodiment of the structural aspect of the present disclosure; and FIG. 4 is an exploded view of the reflector structure 200 of FIG. 3. As the figures show, a number of the at least one first flat plate 210 is plural. The metal substrate 230 includes a substrate 231, a metal layer 232 and a metal loop 233. The substrate 231 has a surface (its reference numeral is omitted). The metal layer 232 is disposed on the surface of the substrate 231 to reflect the radiation emitted by the antenna. The metal loop 233 is disposed between an outer periphery edge of the metal layer 232 and each of the first flat plates 210. It should be noted that the metal loop 233 and each of the first flat plates 210 can be separated from each other or formed integrally, and the cavity 260 is formed by the metal layer 232, the metal loop 233, each of the first flat plates 210 and the second flat plate 220.

In detail, the substrate 231 and the metal layer 232 can also be formed integrally, and a thickness (its reference numeral is omitted) of the substrate 231 and the metal layer 232 is only about a few millimeters so as to minimize the volume of the reflector structure 200 which applies to the current network communication product. Furthermore, the cavity 260 is located between the metal layer 232 and the first flat plates 210, and is a space covered by the metal loop 233; in other words, the cavity 260 of the 2nd embodiment of FIG. 3 and the cavity 160 of the 1st embodiment of FIG. 1 is the same. Moreover, the reflector structure 200 can further include a support element 250 which is connected between the second flat plate 220 and the metal substrate 230 to support and prop against the second flat plate 220. A height of the support element 250 is the same as a height of the metal loop 233, so that the second flat plate 220 and each of the first flat plates 210 can be located on the same horizontal plane. Furthermore, each of the first flat plates 210 is arranged at intervals along the metal loop 233. A slot 270 is located between each two of the first flat plates 210, and each of the slots 270 of the reflector structure 200 is connected to the closed slot 240, respectively, and the cavity 260 is communicated with the closed slot 240 and all of the slots 270. As the 2nd embodiment of FIG. 3 shows, the closed slot 240 and each of the slots 270 are connected to each other in a grillage type, and the closed slot 240 and each of the slots 270 have the same width. However, in other embodiments, the width of the closed slot 240 and the width of each of the slots 270 can be different, so the present disclosure is not limited thereto.

Therefore, the reflector structure 200 of the present disclosure can be applied to the metal reflector of the antenna, and extends the radiation path of the antenna through the closed slot 240, each of the slots 270 and the cavity 260 to achieve high gain characteristics.

Figure 5:
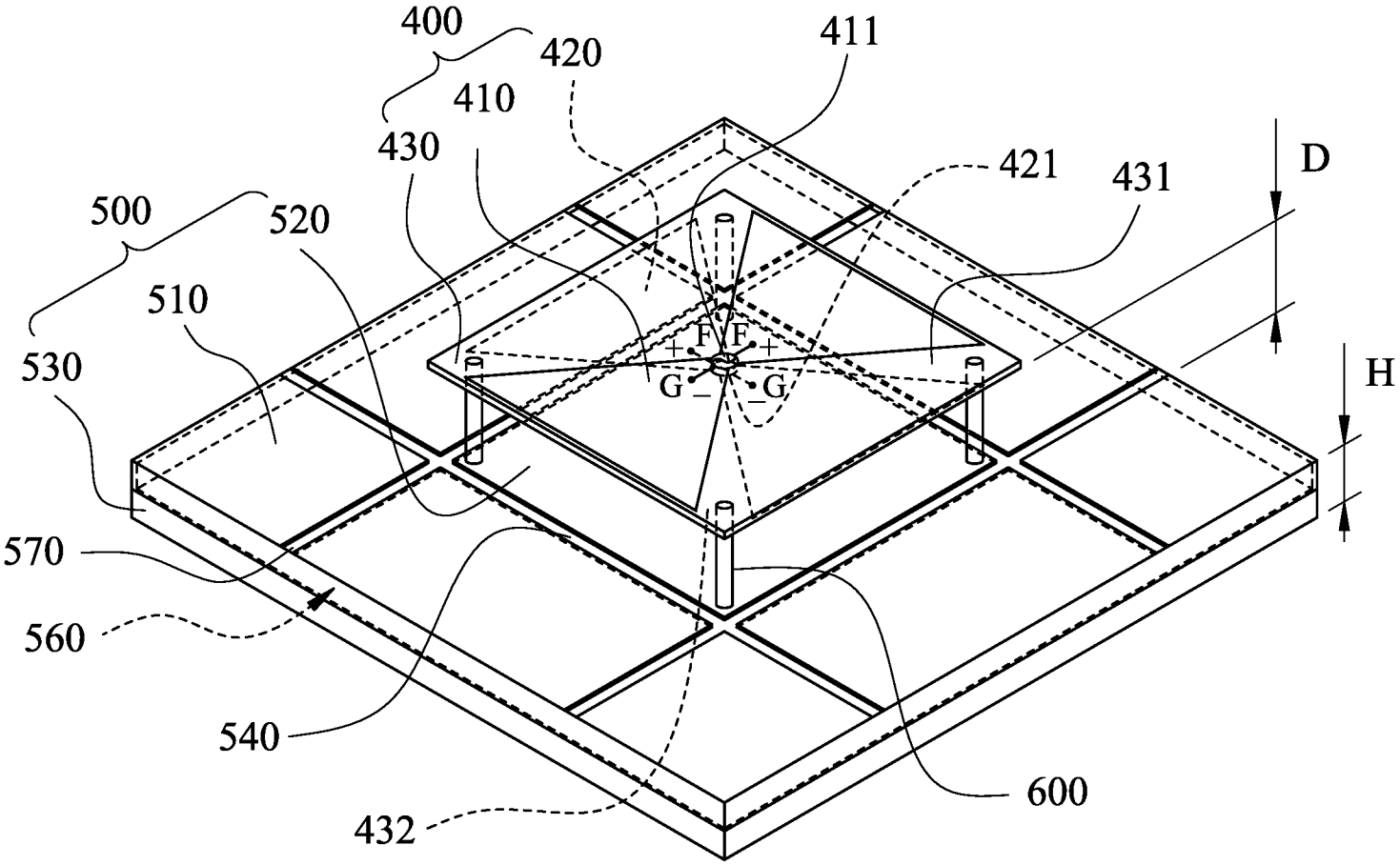
FIG. 5 is a three-dimensional schematic view of an antenna device according to the 3rd embodiment of another structural aspect of the present disclosure.
Figure 6:
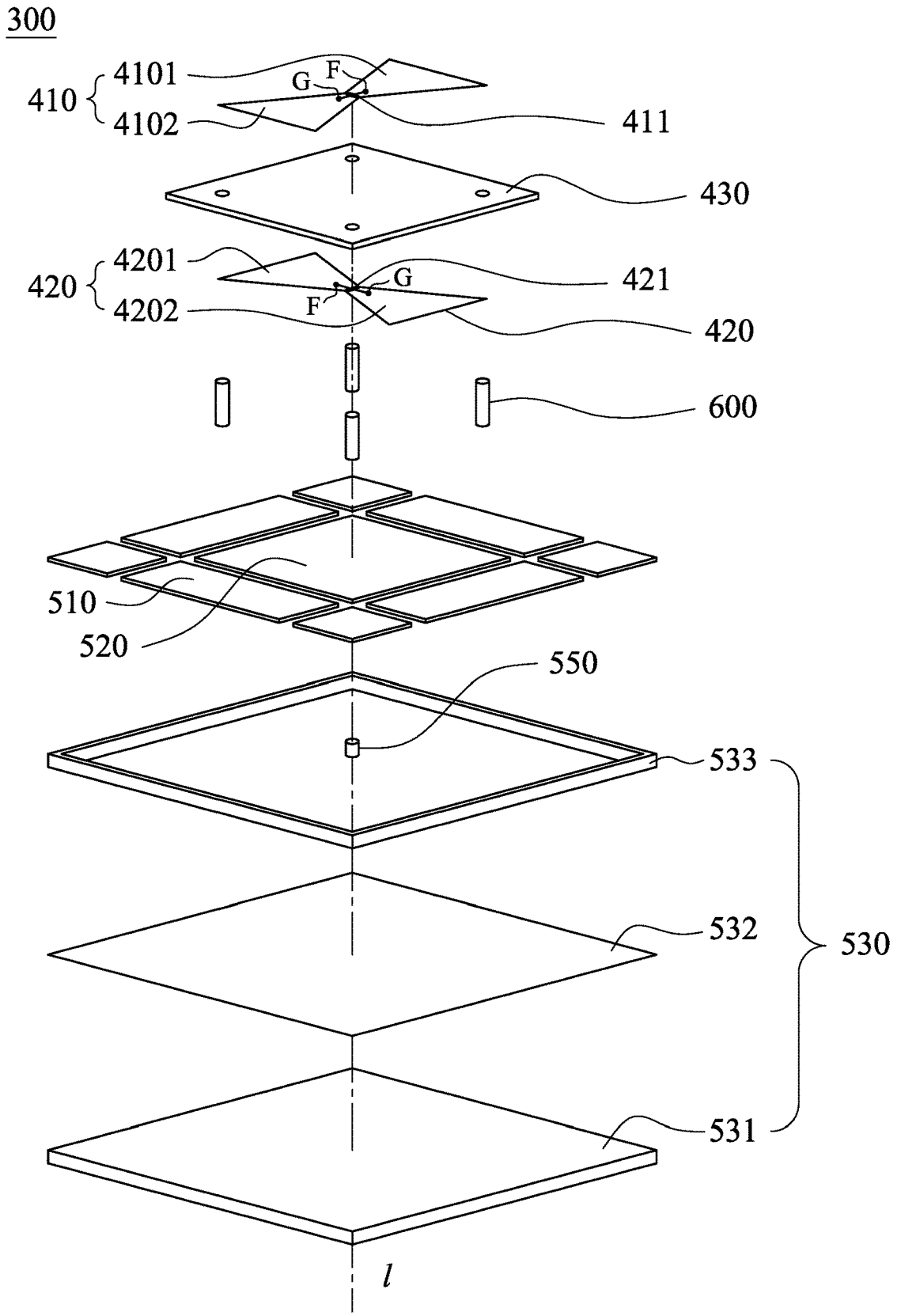
FIG. 6 is an exploded view of the antenna device of FIG. 5.

Please refer to FIGS. 5 and 6. FIG. 5 is a three-dimensional schematic view of an antenna device 300 according to the 3rd embodiment of another structural aspect of the present disclosure; and FIG. 6 is an exploded view of the antenna device 300 of FIG. 5. As the figures show, the antenna device 300 includes an antenna structure 400 and a reflector structure 500. The reflector structure 500 is configured to reflect a radiation emitted by the antenna structure 400. In specific, the antenna structure 400 includes a first antenna element 410, a second antenna element 420 and an antenna substrate 430. The antenna substrate 430 has a first surface 431 and a second surface 432 opposite to the first surface 431. The first antenna element 410 is disposed on the first surface 431, and the second antenna element 420 is disposed on the second surface 432.

In detail, the antenna structure 400 has two excitation sources 411, 421 (that is, the first antenna element 410 has the excitation source 411, and the second antenna element 420 has the excitation source 421), and each of the excitation sources 411, 421 includes a feeding end F and a grounding end G. The first antenna element 410 can be a dipole antenna, which includes a first radiation element 4101 and a second radiation element 4102. The feeding end F of the excitation source 411 is connected to the first radiation element 4101, and the grounding end G of the excitation source 411 is connected to the second radiation element 4102. The second antenna element 420 can also be another dipole antenna, which includes a first radiation element 4201 and a second radiation element 4202. The feeding end F of the excitation source 421 is connected to the first radiation element 4201, and the grounding end G of the excitation source 421 is connected to the second radiation element 4202. Further, in FIG. 5, the first antenna element 410 and the second antenna element 420 are a dual-polarization dipole antenna, and a polarization of the first antenna element 410 and a polarization of the second antenna element 420 are orthogonal to each other.

More detail, the reflector structure 500 is vertically disposed on the antenna structure 400, and includes at least one first flat plate 510, a second flat plate 520 and a metal substrate 530. The metal substrate 530 is configured to reflect the radiation of the first antenna element 410 and the second antenna element 420, and a center of the metal substrate 530 has a virtual normal 1. The at least one first flat plate 510 is disposed on the metal substrate 530. The second flat plate 520 is floated to the metal substrate 530 along the virtual normal, and completely separated from the at least one first flat plate 510 to form a closed slot 540. In addition, the antenna device 300 can further include a support element 550 which is disposed between the second flat plate 520 and the metal substrate 530 to support the second flat plate 520. It is worth explaining that, a cavity 560 is formed by the metal substrate 530, the at least one first flat plate 510 and the second flat plate 520, and communicated with the closed slot 540. It is worth noting that, the closed slot 540 is located on a plane (its reference numeral is omitted), and the excitation sources 411, 421 are projected onto the plane to form two excitation source regions, respectively. The excitation source regions are located in the second flat plate 520. Further, the at least one first flat plate 510, the second flat plate 520 and the closed slot 540 can be located on the plane.

Therefore, the antenna device 300 of the present disclosure changes the radiation path of emitted from the excitation source 411 and the another excitation source 421 through the closed slot 540 and the cavity 560 of the reflector structure 500 so as to maintain excellent antenna impedance matching and high gain radiation characteristics.

In specific, as FIGS. 5 and 6 show, a number of the at least one first flat plate 510 can be plural, and the antenna device 300 can further include a plurality of supporting pillars 600. The supporting pillars 600 are disposed between the antenna substrate 430 and the second flat plate 520. In other embodiment, each of the supporting pillars 600 can also be disposed between the antenna substrate 430 and each of four of the first flat plates 510 to prop against the antenna structure 400.

Moreover, the metal substrate 530 includes a substrate 531, a metal layer 532 and a metal loop 533. The substrate has a surface (its reference numeral is omitted). The metal layer 532 is disposed on the surface to reflect the radiation of the first antenna element 410 and the second antenna element 420. The metal layer 532 can be a general metal material and attached to the substrate 531 through a coating process technology. The metal loop 533 is disposed between an outer periphery edge of the metal layer 532 and each of the first flat plates 510. Therefore, the cavity 560 is formed by the metal layer 532, the metal loop 533, each of the first flat plates 510 and the second flat plate 520.

Figure 7:
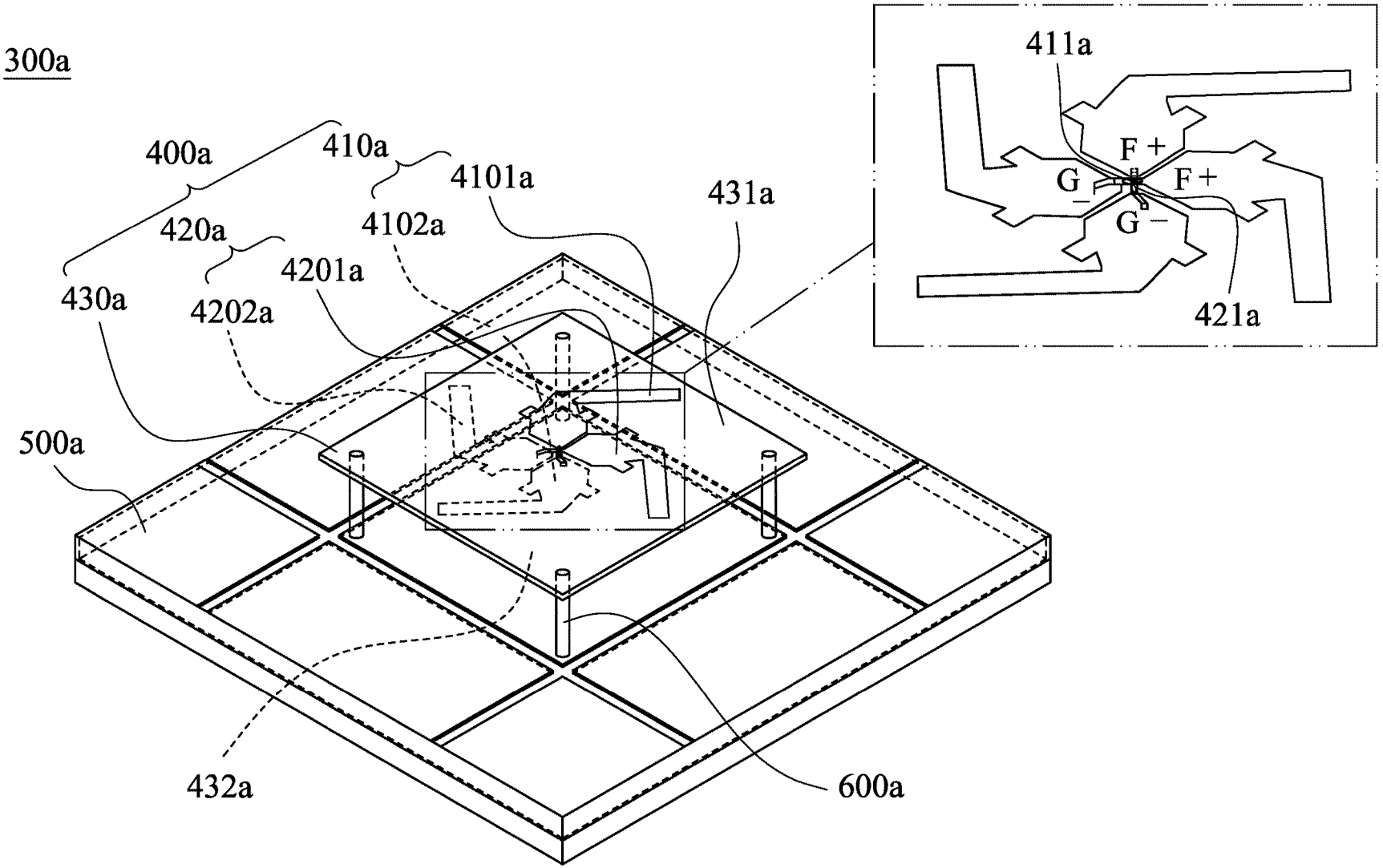
FIG. 7 is a three-dimensional schematic view of an antenna device according to the 4th embodiment of the another structural aspect of the present disclosure.

FIG. 7 is a three-dimensional schematic view of an antenna device 300*a* according to the 4th embodiment of the another structural aspect of the present disclosure. In the 4th embodiment of FIG. 7, the arrangement between the reflector structure 500*a* and the supporting pillars 600*a* is the same as the corresponding elements in the 3rd embodiment of FIG. 5, and will not be detailedly described herein. As FIG. 7 shows, the antenna structure 400*a* can include a first antenna element 410*a*, a second antenna element 420*a* and an antenna substrate 430*a*. The first antenna element 410*a* and the second antenna element 420*a* can be a broadband antenna.

In addition, the antenna substrate 430*a* has a first surface 431*a* and a second surface 432*a* opposite to the first surface 431*a*. The first antenna element 410*a* includes a first radiation element 4101*a* and a second radiation element 4102*a*. The second antenna element 420*a* includes a first radiation element 4201*a* and a second radiation element 4202*a*. In particular, the first radiation element 4101*a* of the first antenna element 410*a* and the first radiation element 4201*a* of the second antenna element 420*a* are both disposed on the first surface 431*a*. The second radiation element 4102*a* of the first antenna element 410*a* and the second radiation element 4202*a* of the second antenna element 420*a* are both disposed on the second surface 432*a*. The first radiation element 4101*a* and the second radiation element 4102*a* of the first antenna element 410*a* are disposed on different surfaces, respectively. The first radiation element 4101*a* and the second radiation element 4102*a* can be connected to each other through a feeding end F and a grounding end G of the excitation source 411*a*. Similarly, the first radiation element 4201*a* and the second radiation element 4202*a* of the second antenna element 420*a* are disposed on different surfaces, respectively. The first radiation element 4201*a* and the second radiation element 4202*a* can be connected to each other through a feeding end F and the grounding end G of the excitation source 421*a*.

Figure 8:
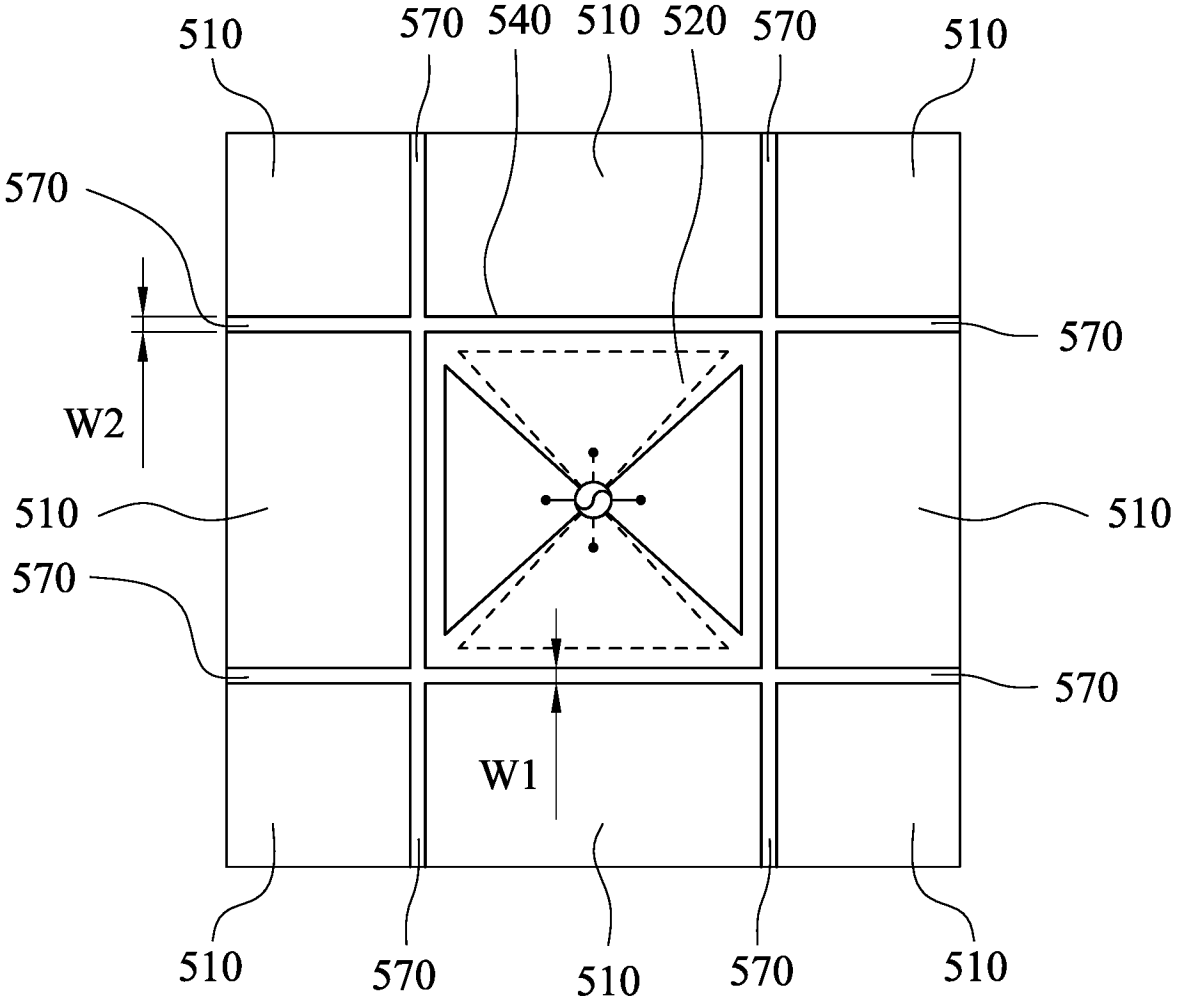
FIG. 8 is a top view of the antenna device of FIG. 5.

Please refer to FIGS. 5 to 8. FIG. 8 is a top view of the antenna device 300 of FIG. 5. In detail, each of the first flat plates 510 is arranged at intervals along the metal loop 533. A slot 570 is located between each two of the first flat plates 510, and each of the slots 570 is connected to the closed slot 540. In more detail, the closed slot 540 can has a first width W1, each of the slots 570 has a second width W2, and the first width W1 and the second width W2 are both greater than or equal to 2 mm and less than or equal to 14 mm, that is, the first width W1 and the second width W2 are between 2 mm to 14 mm, but the present disclosure is not limited thereto. It is worth noting that, the closed slot 540 and each of the slots 570 are connected to each other in a grillage type, and the closed slot 540 has the same width as each of the slots 570 in the 3rd embodiment. However, in other embodiments, the width of the closed slot 540 and each of the slots 570 can be different, so the present disclosure is not limited thereto.

Figure 9:
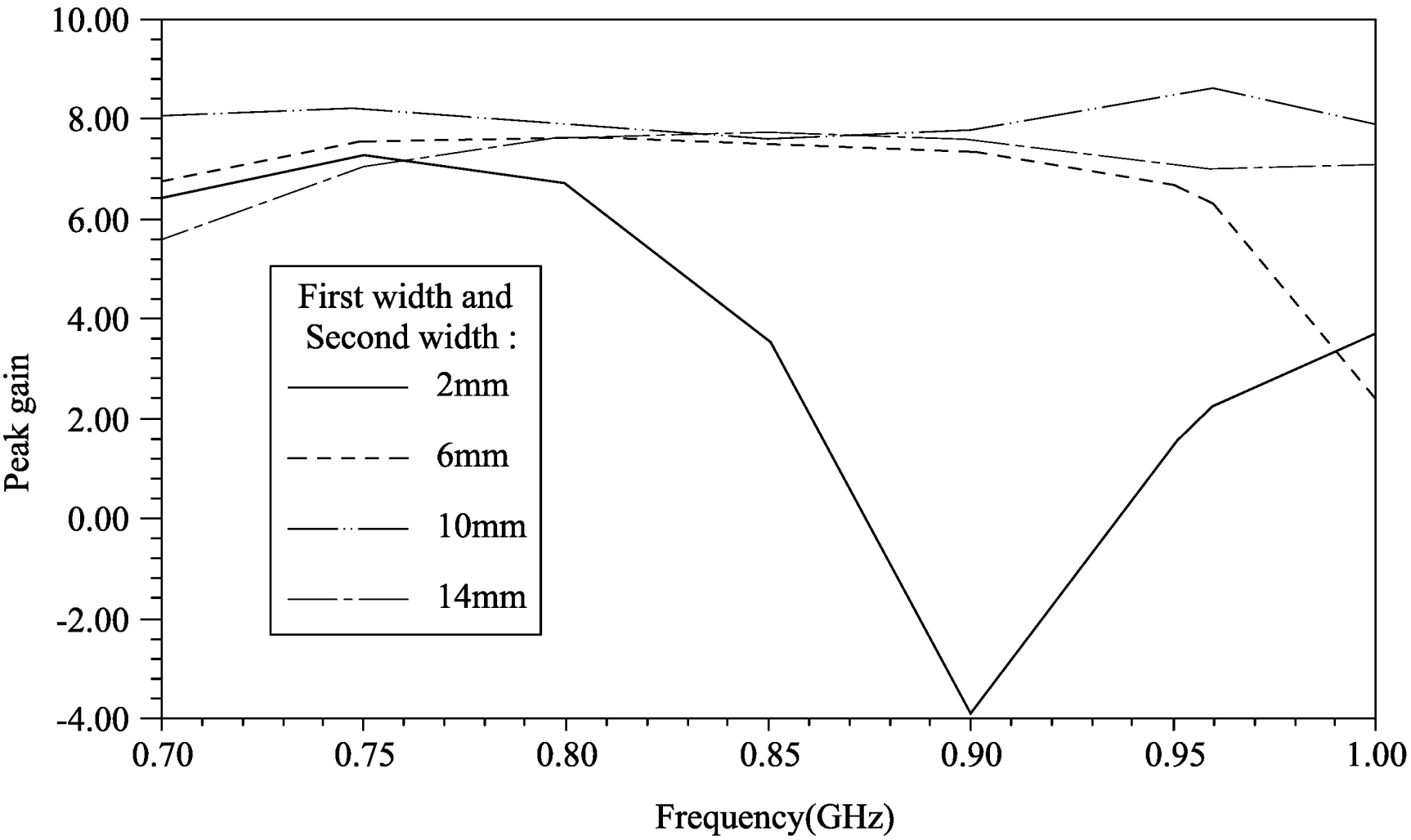
FIG. 9 is a measurement diagram of a peak gain of an antenna structure corresponding to different first widths and second widths of FIG. 5.

FIG. 9 is a measurement diagram of a peak gain of the antenna structure 400 corresponding to different first widths W1 and second widths W2 of FIG. 5. In FIG. 9, the antenna structure 400 can be operable in an operating band and corresponds to the peak gain of the operating band according to the first width W1 and the second width W2. When the first width W1 and the second width W2 are increased, the peak gain of the antenna structure 400 is increased.

Figure 10:
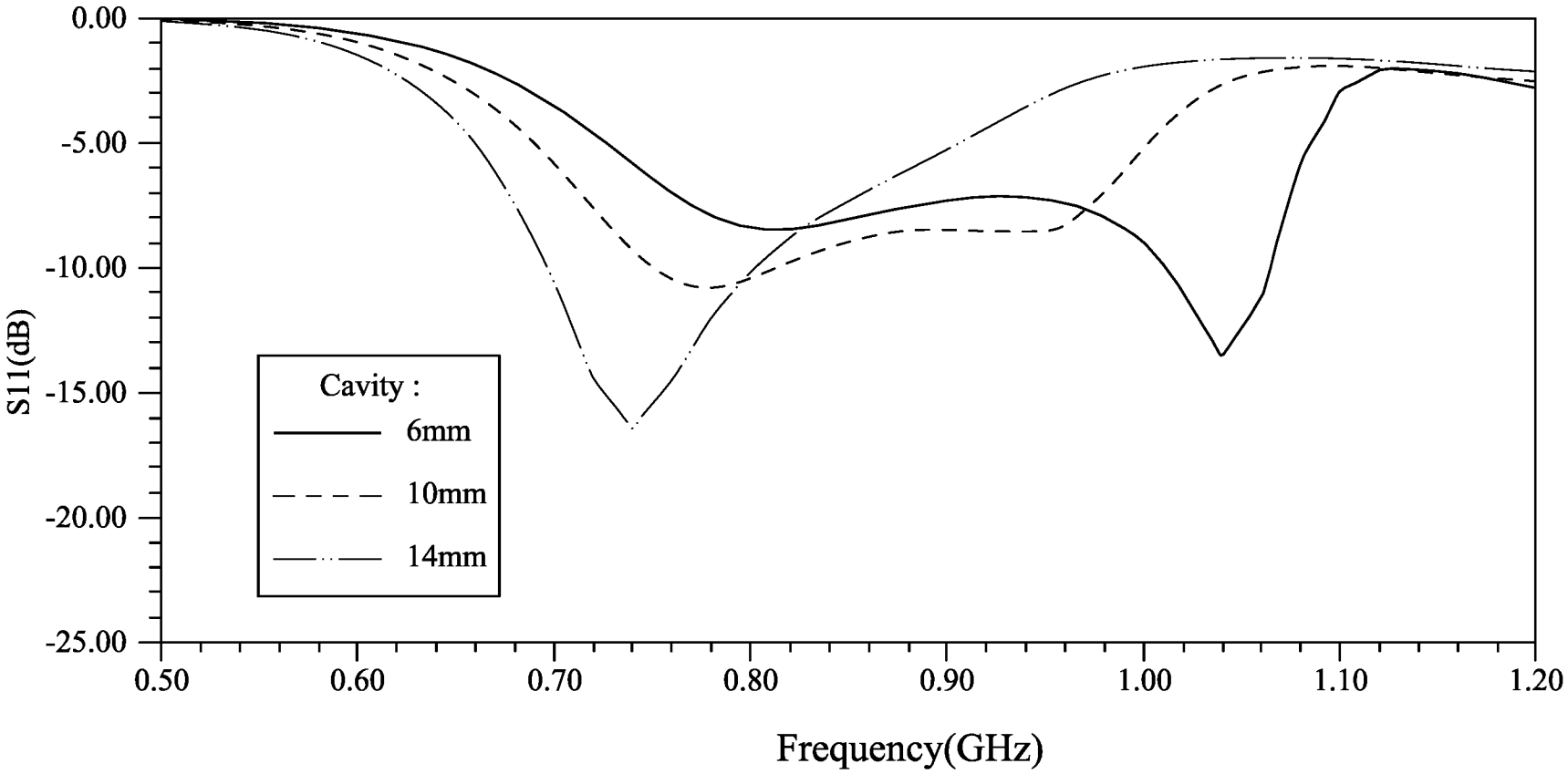
FIG. 10 is a measurement diagram of S11 parameters of the antenna structure corresponding to different heights of FIG. 5.

Please refer to FIGS. 5 and 10. FIG. 10 is a measurement diagram of S11 parameters of the antenna structure 400 corresponding to different heights of FIG. 5. The cavity 560 has a height H which is greater than or equal to 6 mm and less than or equal to 14 mm, that is, the height H of the cavity 560 is between 6 mm and 14 mm, but the present disclosure is not limited thereto.

In FIG. 10, the antenna structure 400 based on the S11 parameter=−6 dB corresponds to the operating band according to the height H. When the height H is increased, the operating band is decreased. In detail, the height H of the cavity 560 is the height of the metal loop 533, and the reflector structure 500 of the present disclosure can correspond to the different operating bands according to the different heights H. For example, when the antenna structure 400 is the dual-polarization dipole antenna, the operating band is between 0.7 GHz and 1 GHz; when the antenna structure 400 is the broadband antenna, the operating band is between 1700 MHz and 2700 MHz, and the dual-polarization dipole antenna and the broadband antenna are the conventional arts and not the focus of the present disclosure, and will not be described in detail herein.

Figure 11:
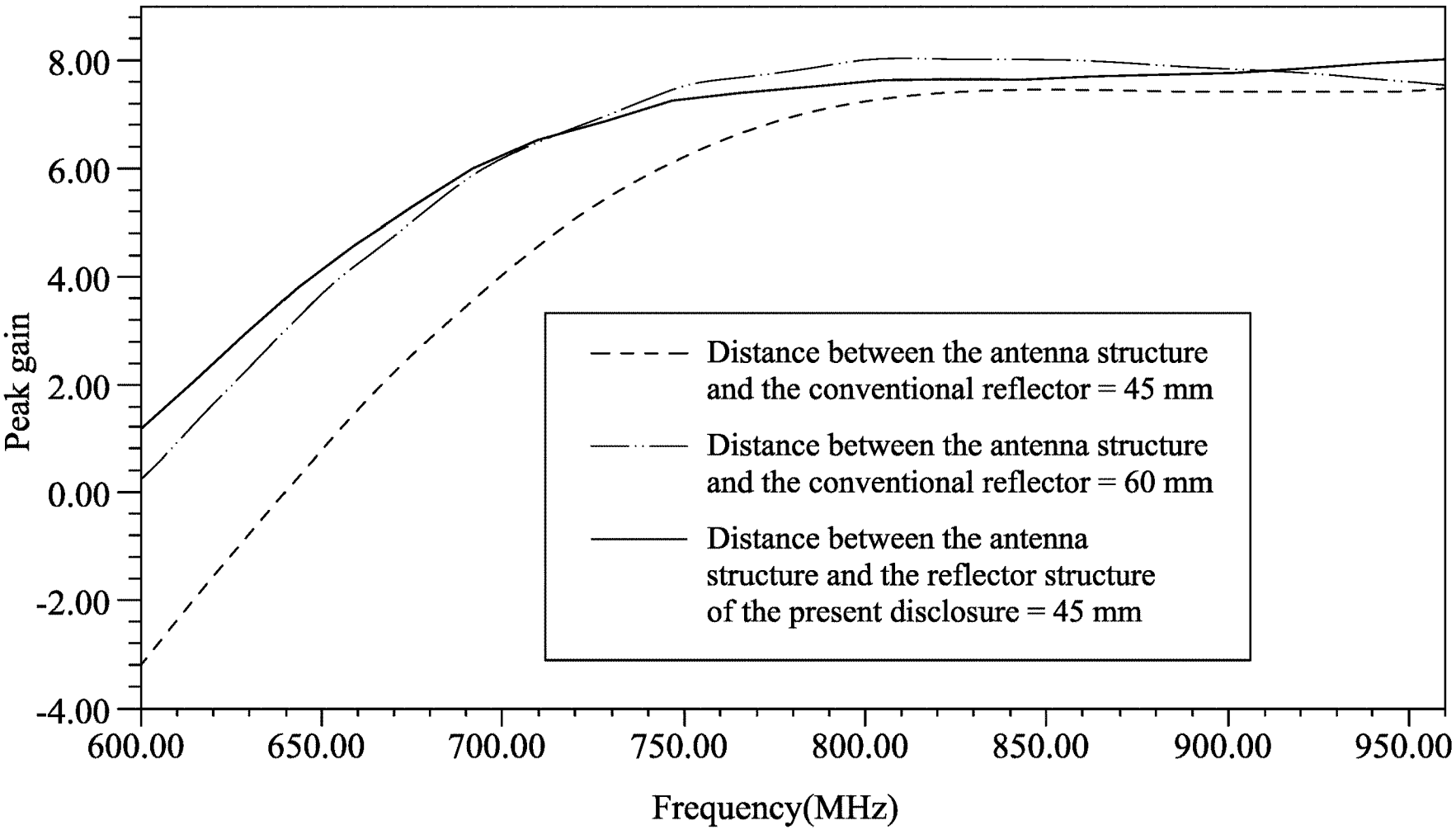
FIG. 11 is a measurement diagram of peak gains of the antenna structure corresponding to different reflectors and distances of FIG. 5.
Figure 12:
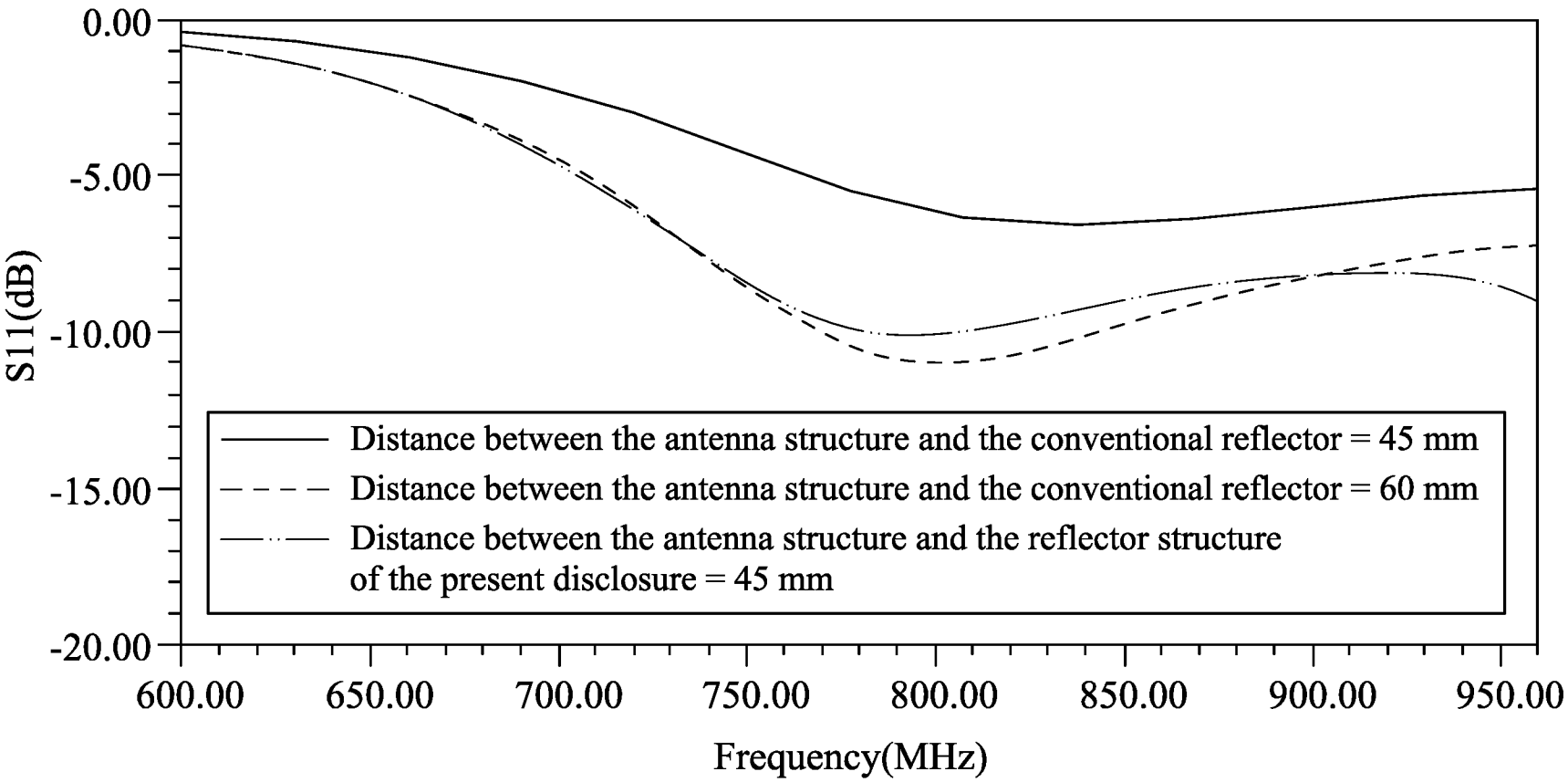
FIG. 12 is a measurement diagram of S11 parameters of the antenna structure corresponding to different reflectors and distances of FIG. 5.
Figure 13A:
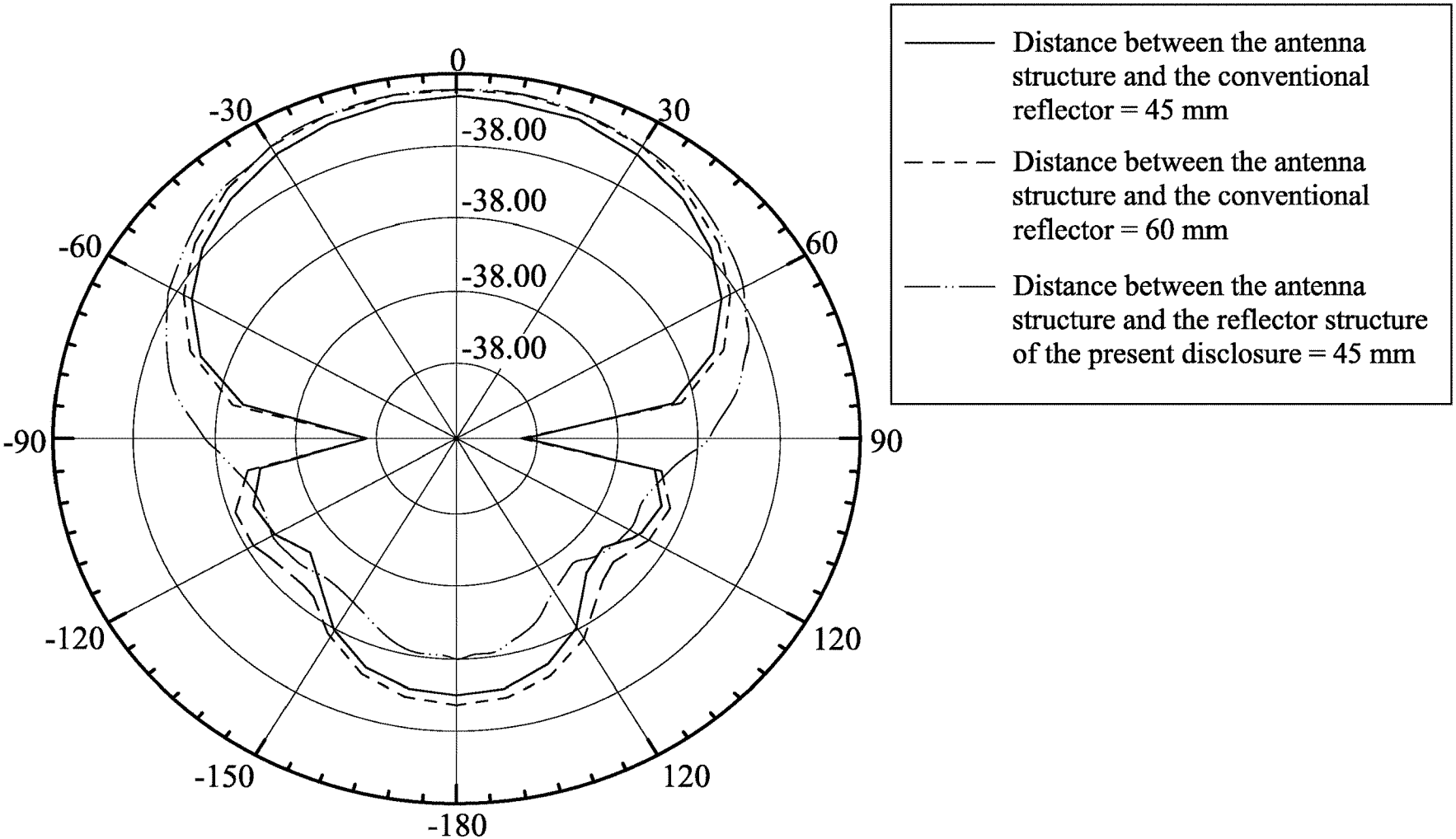
FIG. 13A is a Smith chart of S11 parameters of the antenna structure corresponding to different reflectors and distances of FIG. 5.
Figure 13B:
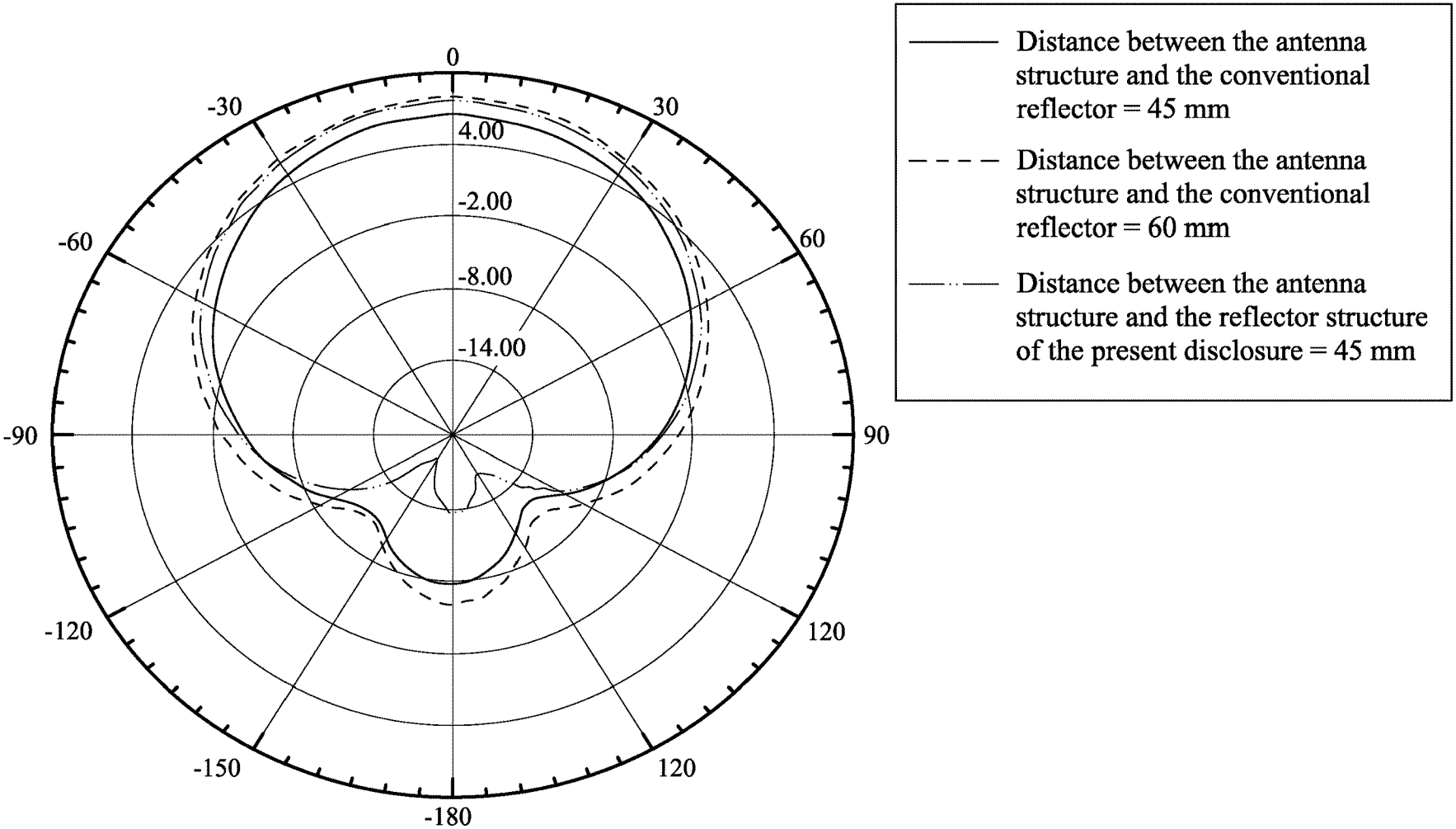
FIG. 13B is another Smith chart of S11 parameters of the antenna structure corresponding to different reflectors and distances of FIG. 5.

Please refer to FIGS. 5 and 11 to 13B. FIG. 11 is a measurement diagram of peak gains of the antenna structure 400 corresponding to different reflectors and distances D of FIG. 5; FIG. 12 is a measurement diagram of S11 parameters of the antenna structure 400 corresponding to different reflectors and distances D of FIG. 5; FIG. 13A is a Smith chart of S11 parameters of the antenna structure 400 corresponding to different reflectors and distances D of FIG. 5; and FIG. 13B is another Smith chart of S11 parameters of the antenna structure 400 corresponding to different reflectors and distances D of FIG. 5. In FIG. 5, a distance D (i.e., the height of each of the supporting pillars 600) is disposed between the antenna structure 400 and the reflector structure 500, and the distance is between 0.1 to 0.2 times of a wavelength in a center frequency of the operating band, but the present disclosure is not limited thereto.

As FIGS. 11 to 13B show, when the distance D between the reflector structure 500 and the antenna structure 400 is compared with the distance between a general antenna and a conventional reflector, the antenna device 300 of the present disclosure can maintain excellent antenna impedance matching (i.e., having better S11 parameters), high gain radiation characteristics (i.e., having higher peak gain) and better front-to-back ratio (F/B ratio) at the same length (e.g., 45 mm). Therefore, the overall height of the antenna device 300 is smaller than the overall height of the conventional antenna by ⅛ wavelength through overlapping the reflector structure 500 and the antenna structure 400.

As shown in the aforementioned embodiments, the present disclosure has the following advantages. First, the antenna device can not only be applied to various antenna structures, but can also achieve the effect of improving peak gain by adjusting the first width and the second width of the reflector structure. Second, it is favorable for reducing the overall height of the antenna device with the reflector structure of the present disclosure so as to reduce the volume. Third, the reflector structure and the antenna device have simple structure, low production cost, and suitable for the application of the current network communication product.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A reflector structure configured to reflect a radiation of an antenna having an excitation source, the reflector structure comprising:

a metal substrate configured to reflect the radiation of the antenna, wherein a center of the metal substrate has a virtual normal;

at least one first flat plate disposed on the metal substrate; and a second flat plate floated to the metal substrate along the virtual normal and completely separated from the at least one first flat plate to form a closed slot;

wherein the closed slot is located on a plane, the excitation source is projected onto the plane to form an excitation source region, and the excitation source region is located in the second flat plate;

wherein the metal substrate comprises:

a substrate having a surface;

a metal layer disposed on the surface of the substrate to reflect the radiation of the antenna; and a metal loop disposed between an outer periphery edge of the metal layer and the at least one first flat plate;

wherein a cavity is formed by the metal layer, the metal loop, the at least one first flat plate and the second flat plate, and the cavity communicated with the closed slot.

2. The reflector structure of claim 1, wherein the at least one first flat plate, the second flat plate and the closed slot are located on the plane.

3. The reflector structure of claim 1, wherein the reflector structure further comprises:

a support element disposed between the second flat plate and the metal substrate to support the second flat plate.

4. The reflector structure of claim 1, wherein a number of the at least one first flat plate is plural, each of the first flat plates is arranged at intervals along the metal loop, a slot is located between each two of the first flat plates, and each of the slots is connected to the closed slot, respectively.

5. The reflector structure of claim 4, wherein the closed slot and each of the slots are connected to each other in a grillage type.

6. The reflector structure of claim 4, wherein the closed slot has a first width, each of the slots has a second width, and the first width and the second width are both greater than or equal to 2 mm and less than or equal to 14 mm.

7. An antenna device, comprising:

an antenna structure having at least one excitation source; and a reflector structure configured to reflect a radiation of the antenna structure, wherein the reflector structure comprises:

a metal substrate having a virtual normal;

at least one first flat plate disposed on the metal substrate; and a second flat plate floated to the metal substrate along the virtual normal and completely separated from the at least one first flat plate to form a closed slot;

wherein the closed slot is located on a plane, the at least one excitation source is projected onto the plane to form an excitation source region, and the excitation source region is located in the second flat plate;

wherein the metal substrate comprises:

a substrate having a surface;

a metal layer disposed on the surface of the substrate to reflect the radiation of the antenna structure; and a metal loop disposed between an outer periphery edge of the metal layer and the at least one first flat plate;

wherein a cavity is formed by the metal layer, the metal loop, the at least one first flat plate and the second flat plate, and the cavity communicated with the closed slot.

8. The antenna device of claim 7, wherein the antenna structure comprises:

an antenna substrate having a first surface and a second surface;

a first antenna element disposed on one of the first surface and the second surface; and a second antenna element disposed on another one of the first surface and the second surface;

wherein the antenna structure is a dual-polarization dipole antenna or a broadband antenna.

9. The antenna device of claim 8, wherein the antenna device further comprises:

a plurality of supporting pillars, wherein each of the supporting pillars is disposed between the antenna substrate and the at least one first flat plate or the second flat plate for supporting the antenna substrate, respectively.

10. The antenna device of claim 7, wherein the antenna device further comprises:

a supporting element is disposed between the second flat plate and the metal substrate for supporting the second flat plate.

11. The antenna device of claim 7, wherein a number of the at least one first flat plate is plural, each of the first flat plates is arranged at intervals along the metal loop, a slot is located between each two of the first flat plates, and each of the slots is connected to the closed slot, respectively.

12. The antenna device of claim 11, wherein the closed slot and each of the slots are connected to each other in a grillage type.

13. The antenna device of claim 11, wherein the closed slot has a first width, each of the slots has a second width, and the first width and the second width are both greater than or equal to 2 mm and less than or equal to 14 mm.

14. The antenna device of claim 13, wherein the antenna structure is operable in an operating band and corresponds to a peak gain of the operating band according to the first width and the second width, when the first width and the second width are increased, the peak gain is increased.

15. The antenna device of claim 7, wherein the antenna structure is operable in an operating band, a distance is disposed between the antenna structure and the reflector structure, and the distance is between 0.1 to 0.2 times of a wavelength in a center frequency of the operating band.

16. The antenna device of claim 7, wherein the cavity has a height, the antenna structure corresponds to an operating band according to the height, when the height is increased, the operating band is decreased.

17. The antenna device of claim 8, wherein the antenna structure is operable in an operating band, when the antenna structure is the dual-polarization dipole antenna, the operating band is between 0.7 GHz and 1 GHz.

18. The antenna device of claim 8, wherein the antenna structure is operable in an operating band, when the antenna structure is the broadband antenna, the operating band is between 1700 MHz and 2700 MHz.

* * * * *